US009326334B2

(12) United States Patent
Fischer et al.

(10) Patent No.: US 9,326,334 B2
(45) Date of Patent: Apr. 26, 2016

(54) ELECTRONIC BALLAST FOR OPERATING AT LEAST ONE FIRST CASCADE OF LEDS

(71) Applicant: OSRAM GmbH, Munich (DE)

(72) Inventors: Klaus Fischer, Friedberg (DE); Helmut Endres, Zusmarshausen (DE); Josef Kreittmayr, Bobingen (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/450,301

(22) Filed: Aug. 4, 2014

(65) Prior Publication Data

US 2015/0048745 A1 Feb. 19, 2015

(30) Foreign Application Priority Data

Aug. 14, 2013 (DE) ..... 10 2013 216 155

(51) Int. Cl.
*H05B 33/08* (2006.01)

(52) U.S. Cl.
CPC ..... *H05B 33/0815* (2013.01); *H05B 33/083* (2013.01); *H05B 33/0827* (2013.01)

(58) Field of Classification Search
CPC ..... H05B 33/0815; H05B 33/0827; H05B 33/083
See application file for complete search history.

(56) References Cited

U.S. PATENT DOCUMENTS

2006/0175985 A1 8/2006 Huynh et al.
2010/0134018 A1 6/2010 Tziony et al.
2011/0248640 A1* 10/2011 Welten ..... 315/210
2011/0273102 A1 11/2011 van de Ven et al.
2012/0176826 A1 7/2012 Lazar
2013/0026924 A1 1/2013 Jong et al.
2014/0191676 A1 7/2014 Seider et al.
2014/0320031 A1* 10/2014 Wu et al. ..... 315/193

FOREIGN PATENT DOCUMENTS

DE 202013000064 U1 3/2013
DE 102011088426 A1 6/2013
KR 100943656 B1 3/2010

(Continued)

OTHER PUBLICATIONS

Search Report issued on Mar. 28, 2014 in the German priority application 10 2013 216 155.7.

(Continued)

*Primary Examiner* — Douglas W Owens
*Assistant Examiner* — Raymond R Chai
(74) *Attorney, Agent, or Firm* — Viering, Jentschura & Partner mbB

(57) ABSTRACT

An electronic ballast for operating at least one first cascade of LEDs may include an input for coupling to an AC supply voltage, a rectifier that is coupled to the input, wherein the rectifier has an output having a first and a second output connection, a first unit that includes the first cascade of LEDs, wherein the first unit is coupled to the first output connection of the rectifier, a series circuit including an inphase regulator and a shunt resistor, wherein the series circuit is coupled between the first unit and the second output connection of the rectifier, a setpoint value prescribing apparatus for the inphase regulator having an output that is coupled thereto, wherein the setpoint value prescribing apparatus provides a first setpoint value element at its output, and a second setpoint value element—superimposed on the first setpoint value element—for the inphase regulator.

17 Claims, 4 Drawing Sheets

(56) References Cited

FOREIGN PATENT DOCUMENTS

| | | | |
|---|---|---|---|
| WO | 2012085800 | A1 | 6/2012 |
| WO | 2013087381 | A1 | 6/2013 |

OTHER PUBLICATIONS

English language abstract of KR 100943656 dated Mar. 3, 2010.

* cited by examiner

ELECTRONIC BALLAST FOR OPERATING AT LEAST ONE FIRST CASCADE OF LEDS

CROSS-REFERENCE TO RELATED APPLICATION

This application claims priority to German Patent Application Serial No. 10 2013 216 155.7, which was filed Aug. 14, 2013, and is incorporated herein by reference in its entirety.

TECHNICAL FIELD

Various embodiments relate to an electronic ballast for operating at least one first cascade of LEDs, including an input having a first and a second input connection for coupling to an AC supply voltage, a rectifier that is coupled to the first and the second input connection, wherein the rectifier has an output having a first and a second output connection, a first unit that comprises the first cascade of LEDs, wherein the first unit is coupled to the first output connection of the rectifier, a series circuit including an inphase regulator and a shunt resistor, wherein this series circuit is coupled in series between the first unit and the second output connection of the rectifier, and a setpoint value prescribing apparatus for the inphase regulator having an output that is coupled to the inphase regulator, wherein the setpoint value prescribing apparatus is designed to provide a first setpoint value element at its output, said first setpoint value element being correlated to the voltage between the output connections of the rectifier. The term "cascade of LEDs" preferably means a multiplicity of LEDs, but such a "cascade" may also comprise just a single LED.

BACKGROUND

In the case of LED driver designs that linearly regulate the LED current and hence the mains current and whose power draw means that it is necessary to ensure a largely sinusoidal current draw from the mains, a resistor divider connected to the rectified AC supply voltage has to date been used to derive a setpoint value for the current regulator. Since this input voltage is sinusoidal, this means that also the setpoint value and, in the case of suitable control design, also the actual value of the mains current are sinusoidal.

However, this arrangement encounters the problem that fluctuations in the mains voltage entail fluctuations in the current, which firstly significantly increases the losses in the linear current regulator in the event of overvoltage and secondly results in an excessively low LED current in the event of undervoltage.

Solutions to date have taken action in the setpoint value formation for the LED current by stipulating a maximum value that never exceeds this setpoint value, for example. However, in the event of overvoltage, this results in the mains current draw no longer being sinusoidal.

Another known option involves the use of a multiplier to produce a setpoint value. In this case, the multiplier multiplies a sinusoidal voltage obtained by means of the aforementioned voltage divider by a value that is constant at least within a few mains half-cycles, and, at its output, provides a sinusoidal voltage having an amplitude that is variable in comparison with the mains voltage. A drawback in this case is the relatively high level of circuit complexity for the multiplier.

SUMMARY

The object of the present disclosure is therefore to develop an electronic ballast as cited at the outset such that firstly the usual limit values for the mains current harmonics are observed and secondly a large degree of independence for the power draw with respect to the RMS value of the mains voltage is ensured as inexpensively as possible.

Various embodiments provide a second setpoint value element—superimposed on the first setpoint value element—for the inphase regulator such that the maximum value of the mains current assumes a prescribable value regardless of fluctuations in the RMS input voltage. For this purpose, the present disclosure provides for the second setpoint value element to be inversely correlated to the peak value of the current through the inphase regulator.

As a result of suitable adjustment of the ratio of sinusoidal current component—represented by the first setpoint value element—and direct current which is essentially constant over time within a prescribable period—represented by the second setpoint value element—for the purpose of setpoint value production, the curve shape of the mains current can be customized such that firstly the usual limit values for mains current harmonics are observed and secondly a large degree of independence for the power draw with respect to the RMS value of the voltage is ensured.

In various embodiments, the setpoint value prescribing apparatus includes a first voltage divider having a first and a second nonreactive resistor that is coupled between the first and the second output connection of the rectifier, wherein the first setpoint value element is correlated to the voltage drop across the second resistor owing to the current through the first resistor. For a low level of complexity, this allows the first setpoint value element to be provided such that it is correlated to the voltage between the output connections of the rectifier.

In various embodiments, the second nonreactive resistor of the first voltage divider, which is coupled between the tap of the first voltage divider and the second output connection of the rectifier, has a capacitor connected in parallel with it. Said capacitor is used to intercept high-frequency spikes in the input voltage.

According to various embodiments, the setpoint value prescribing apparatus includes an apparatus element for providing the second setpoint value element, wherein the apparatus element has its input coupled to the shunt resistor and its output coupled to the tap of the first voltage divider, wherein the apparatus element is designed to impress a current that is inversely correlated to the peak value of the current through the inphase regulator into the second nonreactive resistor of the first voltage divider. Accordingly, a current that represents the first current value element and that flows through the first nonreactive resistor of the first voltage divider and the current that represents the second current value element and that is provided by the apparatus element are superimposed on the second nonreactive resistor of the first voltage divider.

In various embodiments, the setpoint value prescribing apparatus includes a first operational amplifier, the negative input of which is coupled to the shunt resistor, particularly via a nonreactive resistor, and the positive input of which is coupled to the tap of the first voltage divider. This provides a control signal for the inphase regulator in a particularly simple manner.

In this case, the first operational amplifier may be connected up such that it acts as a P controller, as a PI controller or as an I controller.

It has been found to be advantageous if the apparatus element furthermore includes a second operational amplifier, the positive input of which is coupled to the tap of a second voltage divider coupled to a DC supply voltage, the negative input of which is coupled to the shunt resistor and the output of which is coupled to the tap of the first voltage divider.

The second voltage divider can be used to provide a setpoint value for the peak value of the LED current. By coupling the output of the second operational amplifier, particularly via a nonreactive resistor, to the tap of the first voltage divider, the current produced by the apparatus element is superimposed on the second resistor of the first voltage divider—in addition to the current flowing via the first resistor of the first voltage divider.

In this connection, it is preferred if the apparatus element furthermore includes a diode and a capacitor, wherein the diode is coupled in series between the shunt resistor and the negative input of the second operational amplifier and wherein the capacitor is coupled between the negative input of the second operational amplifier and a reference-ground potential. In this way, the peak value of the LED current is recorded in each mains half-cycle and stored in the capacitor.

In this case, the LED current is recorded with the shunt resistor that is used for the current regulation anyway and converted into a voltage. This voltage is then stored in said capacitor. So that the voltage stored in the capacitor follows the time-variant peak value of the voltage drop across the shunt resistor by increasing and decreasing, it is preferred if the capacitor has a nonreactive resistor connected in parallel with it.

It has been found to be particularly advantageous if the diode is in the form of a double diode, wherein the node between the two diodes is coupled to a DC supply voltage. Preferably, the node between the two diodes and the DC supply voltage have a further nonreactive resistor arranged between them. This approach achieves compensation for the temperature dependency of the diode. Preferably, the resistor arranged between the coupling point between the two diodes and the DC supply voltage is several orders of magnitude larger in this case than the shunt resistor, as a result of which the current flowing through the further nonreactive resistor essentially does not influence the voltage across the shunt resistor and hence the actual value of the current.

The dimensioning of the capacitor and of the nonreactive resistor connected in parallel with the capacitor allows the averaging time to be adjusted, as a result of which it is possible to take account of relatively long-term fluctuations in the AC supply voltage, but brief fluctuations are masked out.

In various embodiments, the averaging time is adjusted such that the offset—added as a result of the second setpoint value element—in the current setpoint value is essentially constant over two to three periods of the AC supply voltage. For this purpose the second operational amplifier is preferably connected up such that it acts as an I controller.

The second voltage divider preferably includes a first and a second nonreactive resistor, wherein the second nonreactive resistor, which is arranged between the tap of the second voltage divider and a reference-ground potential, has a capacitor connected in parallel with it. Said capacitor is used to suppress interference voltages. This connection allows the I controller formed by the second operational amplifier to impress on the second nonreactive resistor of the first voltage divider a current that, in addition to the current through the first nonreactive resistor, produces a voltage drop across the second nonreactive resistor that is in turn used as a setpoint value for the linear controller.

For a particularly good control characteristic, it is preferred for the second nonreactive resistor of the first voltage divider to be dimensioned such that without further current impression via the second operational amplifier an LED current that tends to be too small would flow. Preferably, the second nonreactive resistor of the first voltage divider is attuned such that at rated voltage a setpoint value, provided for the linear controller, that is 15% too small will be obtained, for example. This ensures that the second operational amplifier is always engaged.

Without the measures according to the present disclosure, the linear controller would convert any overvoltage into thermal energy if it were merely regulated using the first voltage divider known from the prior art. At 10% more overvoltage, 10% more current would therefore also be produced. Since power is proportional to the product of voltage and current, this would result—in the case of the approach based on the prior art—in $1.1 \times 1.1 = 1.21$ and hence 21% more power loss in the electronic ballast.

According to an advantageous development, the second nonreactive resistor of the first voltage divider has an auxiliary apparatus coupled to it that is designed to adjust the edge gradient and/or the instant of the onset of the voltage drop across the second nonreactive resistor. This allows the operating behavior to be further improved and the mains current curve shape to be optimized. The auxiliary apparatus allows that portion of the setpoint value that corresponds to the second current value element to be reduced or zeroed on the basis of the voltage provided by the first voltage divider. The second current value element allows a component that is constant over a prescribable period in relation to the period duration of the supply system to be added that also results in improved use of the LEDs. However, this essentially constant offset would also form a setpoint value in the time domain in which no mains current can flow, which can result in the current regulator becoming saturated. The auxiliary apparatus allows adjustment of the gradient of the setpoint value rise (rising edge of the AC supply voltage) or of the setpoint value fall (falling edge of the AC supply voltage) and also the position of the edges in relation to the phase of the input voltage.

The auxiliary apparatus preferably includes an electronic switch having a control electrode, an operating electrode and a reference electrode, wherein the control electrode is coupled to the tap of a third voltage divider having a first and a second nonreactive resistor that is connected in parallel with the first voltage divider. To this end, the third voltage divider is dimensioned such that the electronic switch of the auxiliary apparatus reduces the setpoint value to zero when the input voltage is lower than the forward voltage of the LEDs in the first cascade and hence no mains current can flow.

In this case, the second nonreactive resistor of the third voltage divider, which is coupled between the tap of the third voltage divider and a reference-ground potential, may have a zener diode and/or a capacitor connected in parallel with it. A suitable choice of capacitance for this capacitor that is connected in parallel with the second nonreactive resistor of the third voltage divider allows adjustment of the edge gradient of the voltage across the second nonreactive resistor of the first voltage divider, which voltage corresponds to the setpoint value for the current regulator, during the onset of the mains current. The zener diode is used merely to limit the voltage between the control electrode and reference electrode of the electronic switch of the auxiliary apparatus.

The electronic ballast may furthermore include at least one second unit, preferably a multiplicity of second units, having a second cascade of LEDs that is coupled between the first unit and the series circuit including inphase regulator and shunt resistor, wherein the respective second cascade of LEDs has an electronic switch connected in parallel with it. Optionally, the first cascade of LEDs may also have an electronic switch connected in parallel with it. In this way, depending on the instantaneous amplitude of the voltage provided at the output of the rectifier, different cascades of LEDs or different combinations of cascades of LEDs may be active in order to make optimum use of the input voltage.

In various embodiments, the respective cascade of LEDs has a buffer capacitor connected in parallel with it in order to reduce ripple at twice the frequency of the AC supply voltage. In other words, the LEDs in the respective cascade can accordingly be powered from the respective buffer capacitors in the phases in which the input voltage is not sufficient to operate said LEDs.

In this connection, at least one unit, preferably each unit, includes a diode that is coupled in series with the parallel circuit including respective LED cascade and respective buffer capacitor. This prevents the buffer capacitor associated with a respective LED cascade from discharging through the electronic switch connected in parallel.

Finally it is preferred if the first and/or the third voltage divider is coupled to the coupling point between the first unit and the second unit, on the one hand, and the second output connection of the rectifier, on the other hand. This variant is appropriate when the first unit does not have a switch, which means that it is in nonbypassable form. If the first voltage divider is now connected up as mentioned, the effect achieved is that a setpoint value of greater than zero is formed only when the input voltage is higher than the forward voltage of the unbypassed portion of the LEDs.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the present disclosure. In the following description, various embodiments of the present disclosure are described with reference to the following drawings, in which.

DETAILED DESCRIPTION

The following detailed description refers to the accompanying drawings that show, by way of illustration, specific details and embodiments in which the invention may be practiced.

Figure 1:
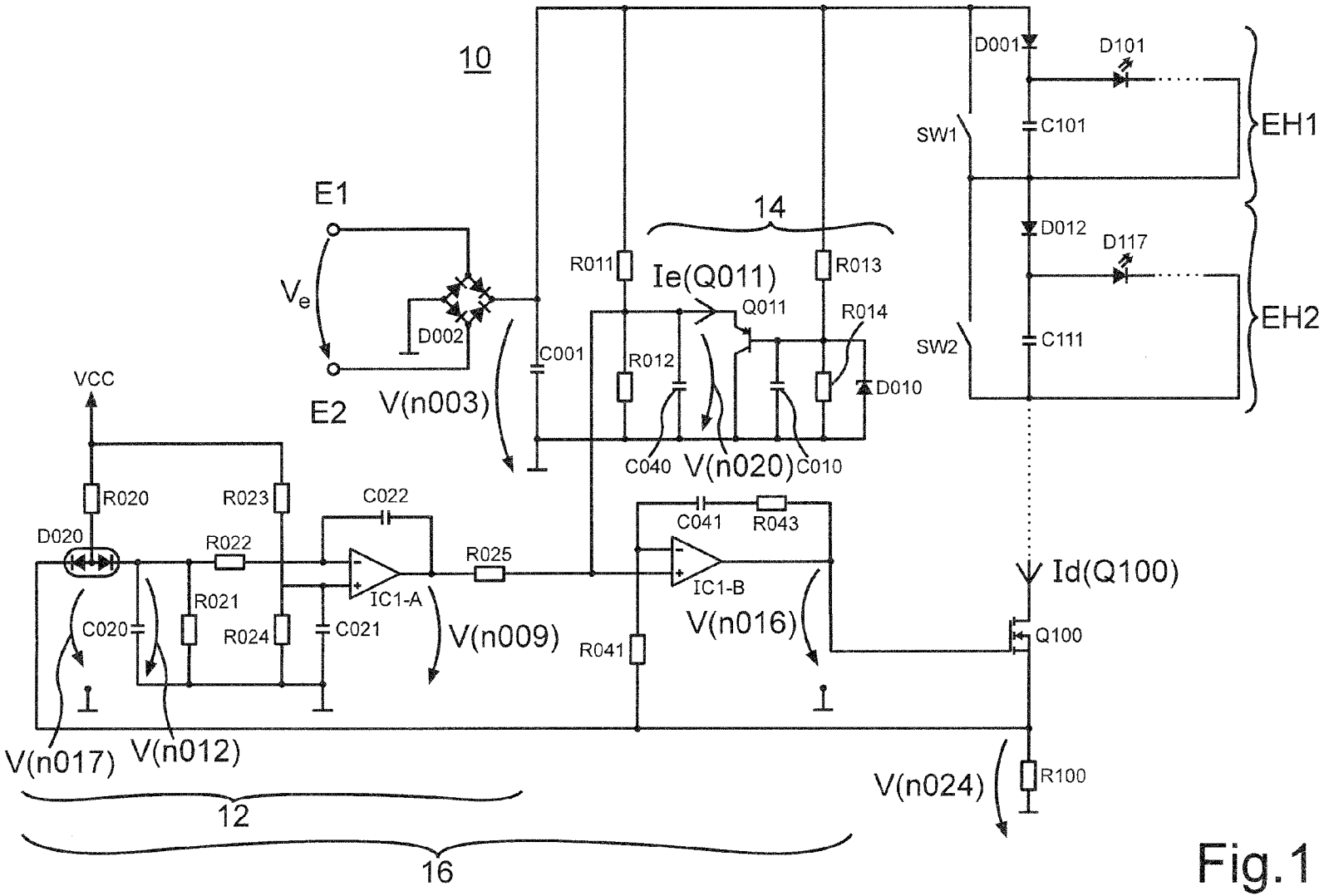
FIG. 1 shows a schematic illustration of an embodiment of an electronic ballast according to the present disclosure.

FIG. 1 shows a schematic illustration of an embodiment of an electronic ballast 10 according to the present disclosure. The ballast 10 according to the present disclosure has an input having a first E1 and a second E2 input connection between which an AC supply voltage $V_e$ is applied, which may be 230 V, 50 Hz, for example. Said voltage is applied to a rectifier D002, which in the present case has four diodes. The voltage provided at the rectifier output is denoted by V(n003). An optional capacitor C001 is used to eliminate high-frequency spikes on the AC supply voltage $V_e$.

A first unit EH1 includes a cascade of LEDs, i.e. preferably a multiplicity of LEDs connected in series, the "cascade" also being able to comprise just one LED. By way of example, only the LED denoted by D101 is shown in the present case. The cascade has an optional buffer capacitor C101 connected in parallel with it. Coupled in series between the first output connection and the parallel circuit including buffer capacitor C101 and first cascade of LEDs is a diode D001, this series circuit in turn having an electronic switch SW1 connected in parallel with it.

A second unit EH2 likewise includes a cascade of LEDs, only the LED D117 being shown by way of example in this case. This cascade in turn has an optional buffer capacitor C111 connected in parallel with it. Furthermore, the second unit includes a diode D012 that is coupled between the unit EH1 and the parallel circuit including LED cascade and buffer capacitor C111. Coupled in parallel with the series circuit including diode D012 and parallel circuit including LED cascade D117 and buffer capacitor C111 is a switch SW2.

The present disclosure described in more detail below may also be implemented with just one unit EH1, in which case the switch SW1 may also be omitted. As mentioned, the capacitor C101 is optional. Preferably, however, a multiplicity of second units EH2 are arranged in series with the first unit EH1, and if the respective buffer capacitor C111 is dispensed with then it is also possible to omit the respective diode D012. On the basis of the input voltage $V_e$, the switches SW1, SW2 may be used to control which LED cascade(s) is/are in operation.

Connected in series with the units EH1, EH2 is the series circuit including an inphase regulator Q100 and a shunt resistor R100.

The current flowing into the inphase regulator Q100 is denoted by $I_d$(Q100). This current always corresponds to the mains current, i.e. the current that is taken from the supply system connected to the input. Without the use of buffer capacitors, this current corresponds to the LED current. The voltage drop across the shunt resistor R100 is denoted by V(n024). This voltage V(n024) also includes the temperature dependency and also the variation in terms of the forward voltage of the LEDs that each carry the LED current $I_d$(100).

A setpoint value prescribing apparatus for producing a setpoint value for the inphase regulator Q100 is denoted by 16.

In order to produce a first component—which is sinusoidal for an appropriate input voltage $V_e$—of a setpoint value that is applied to the control electrode of the inphase regulator Q100, a voltage divider is provided that is coupled between the output terminals of the rectifier D002 and includes the nonreactive resistors R011 and R012. The voltage drop across the nonreactive resistor R012 is applied to the positive input of an operational amplifier IC1-B, the negative input of which is coupled to the shunt resistor R100 via a nonreactive resistor R041. The voltage at the output of the operational amplifier IC1-B is denoted by V(n016). The voltage drop across the nonreactive resistor R012 is denoted by V(n020). An optional capacitor C040 connected in parallel with the nonreactive resistor R012 is used to intercept high-frequency spikes in the voltage V(n020) at the tap of the first voltage divider. Coupled in the feedback loop of the operational amplifier IC1-B is the series circuit including a nonreactive resistor R043 and a capacitor C041, in order to design said operational amplifier as a PI controller.

In order to produce a second setpoint value element, an apparatus element 12 is provided that provides a voltage V(n009) at its output and shapes a second current component through the second nonreactive resistor R012 by means of a nonreactive resistor R025. In order to produce this current component, the peak value of the current $I_d$(Q100) is recorded by the inphase regulator Q100 by means of the shunt resistor R100, and stored in the capacitor C020. In the present case, peak value detection is effected by means of a double diode D020, the coupling point between the two diodes being coupled to a DC supply voltage via a nonreactive resistor R020. In comparison with the use of just one diode, this arrangement allows the temperature dependency of the diode(s) to be compensated for.

The voltage drop at the coupling point between the two diodes is denoted by V(n017), while the voltage drop across the capacitor C020 is denoted by V(n012). So that the voltage stored in the capacitor C020 follows the time-variant peak value of the voltage drop across the shunt resistor R100 by increasing and decreasing, the capacitor C020 has a resistor R021 connected in parallel with it.

The thus stored peak value of the LED current $I_d$(Q100) is applied via a resistor R022 to the negative input of a further operational amplifier IC1-A, the positive input of which has a setpoint value for the peak value of the LED current $I_d$(Q100) applied to it by means of a further voltage divider, which includes the nonreactive resistors R023 and R024. In order to suppress interference voltages, the resistor R024 may have a capacitor C021 connected in parallel with it.

The output of the operational amplifier IC1-A, which forms an I controller on account of the negative feedback capacitor C022, is connected to the resistor R012 via the nonreactive resistor R025, as already mentioned. This interconnection allows the I controller formed by the operational amplifier IC1-A to impress onto the resistor R012 a current that, in addition to the current through the resistor R011, produces a voltage drop across the resistor R012 that is in turn used as a setpoint value for the actual linear controller Q100.

For a good control characteristic, R012 is dimensioned such that without further current impression via the operational amplifier IC1-A an LED current $I_d$(Q100) that tends to be too small would flow, for example by 10 to 20%, preferably 15%. This ensures that the operational amplifier IC1-A is always engaged.

Since the setpoint value element provided by the operational amplifier IC1-A would, however, form a setpoint value even in the time domain in which no mains current can flow because the instantaneous input voltage is lower than the lowest forward voltage of an LED cascade, this could result in a saturation state for the linear controller Q100. This means that if the mains voltage V, subsequently increases again and in so doing rises above the lowest forward voltage of an LED cascade again, the current regulator requires a transient time in which the mains current is larger than the desired value corresponding to the setpoint value. This overshoot in the mains current has an adverse effect on the behavior of the overall arrangement in terms of mains current harmonics and radio interference.

However, an auxiliary apparatus 14 may prevent such overshoots in the mains current, i.e. in the current drawn from the mains, by virtue of the setpoint value that drops across the resistor R012 being able to be reduced or zeroed on the basis of the voltage provided by a voltage divider. In particular, this allows adjustment of the gradient of the setpoint value rise for a rising edge of the supply voltage $V_e$ or of the setpoint value fall for a falling edge of the supply voltage $V_e$ and also the position of the edges in relation to the phase of the input voltage $V_e$.

To this end, a voltage divider is provided that includes the nonreactive resistors R013 and R014. The tap of this voltage divider is coupled to the control electrode of a transistor Q011. The resistors R013, R014 of this voltage divider are dimensioned such that the transistor Q011 reduces the setpoint value to zero when the input voltage $V_e$ is lower than the lowest forward voltage of an LED cascade, so that no mains current can flow.

A suitable choice for the capacitance of a capacitor C010 that is connected in parallel with the resistor R014 allows the edge gradient of the voltage across the resistor R012, which voltage corresponds to the setpoint value of the linear controller Q100, to be adjusted during the onset of the mains current. A zener diode D010 connected in parallel with the capacitor C010 is used to limit the base/emitter voltage of the switch Q011. The current flowing into the emitter of the transistor Q011 is denoted by $I_e$(Q011).

Figure 2:
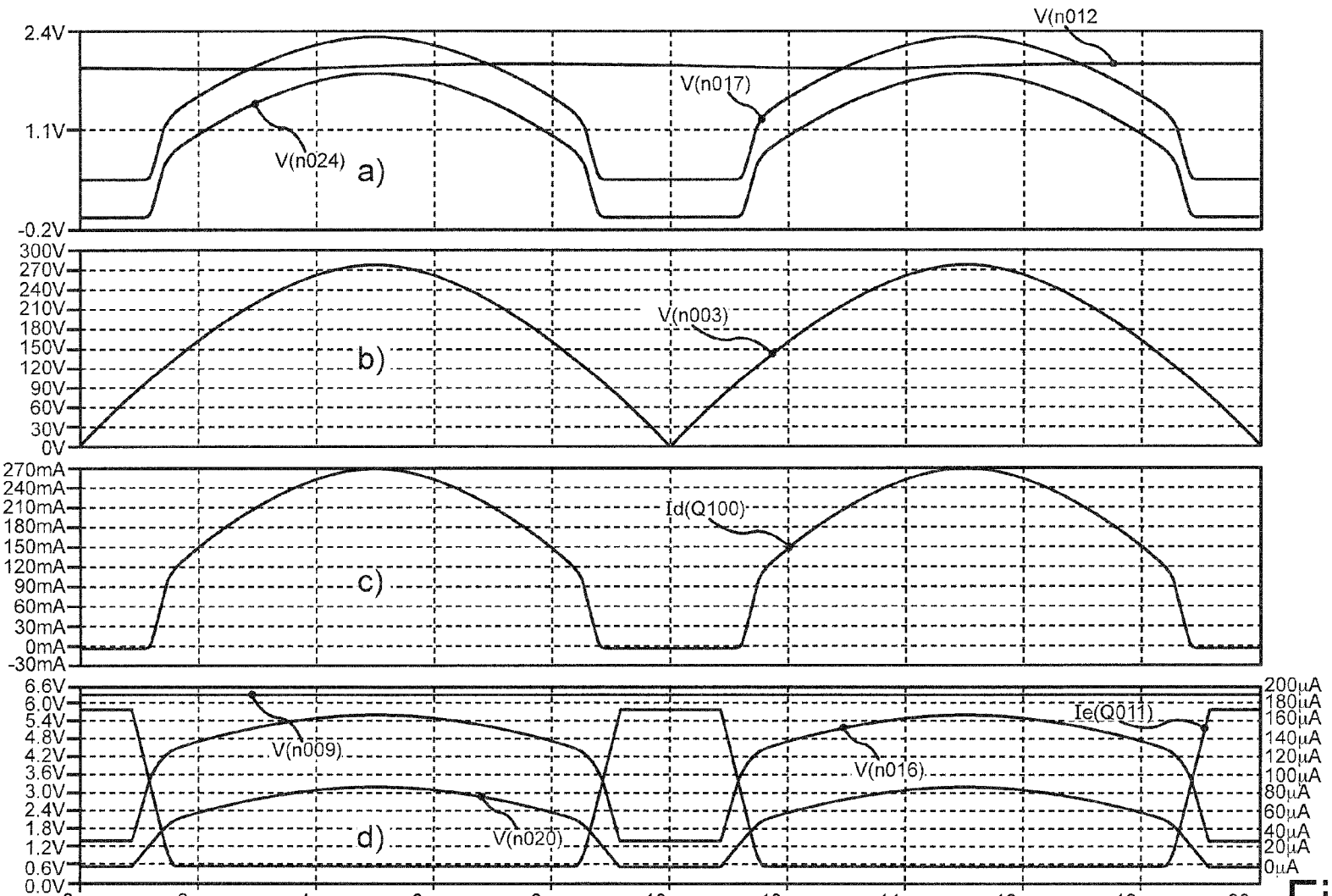
FIG. 2 to FIG. 4 show the time profile of various variables for the electronic ballast shown in FIG. 1 during operation with input voltages that differ in amplitude.
Figure 3:
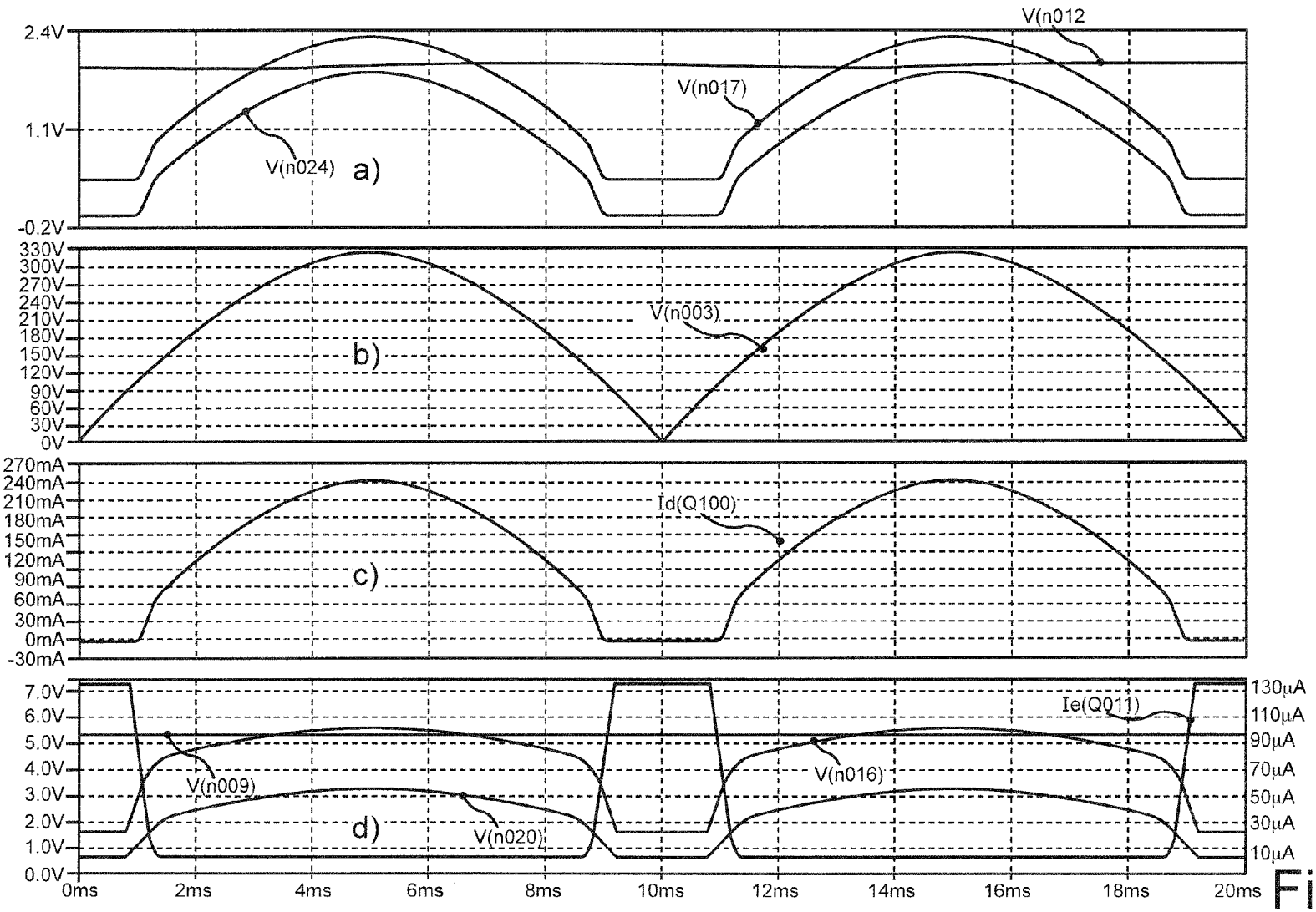
Figure 4:
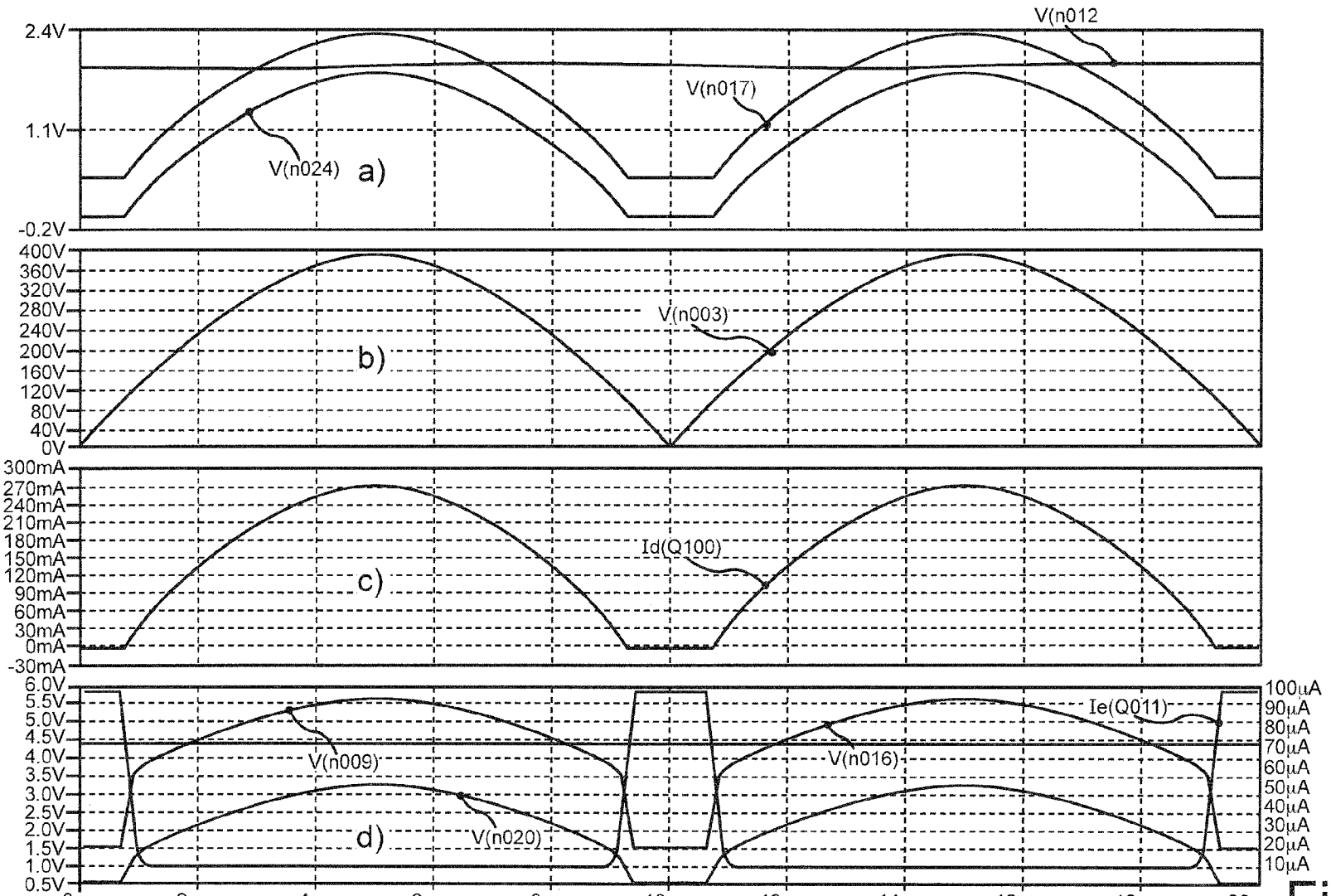

FIGS. 2 to 4 show the time profile of various variables for the electronic ballast shown schematically in FIG. 1 for different values of the input voltage $V_e$. Thus, the respective illustration a) shows the time profile of the voltages V(n024), V(n017) and V(n012). The respective illustration b) shows the time profile of the voltage V(n003), the respective illustration c) shows the profile of the current $I_d$(Q100) and the respective illustration d) shows the profile of the voltages V(n009), V(n020), V(n016) and of the current $I_e$(Q011).

As can be seen from the respective curve profile in the respective illustration b), the peak value of the voltage V(n003) at the rectifier output is 280 V in the illustration of FIG. 2, 320 V in the illustration of FIG. 3, and 360 V in the illustration of FIG. 4. From the respective illustration c) it can clearly be seen that the current component superimposed as a result of the second setpoint value element becomes all the greater the smaller the peak value of the input voltage. Thus, the effect achieved in the present case is that regardless of the value of the input voltage $V_e$ the peak value of the current $I_d$(Q100) through the inphase regulator Q100 is always approx 270 mA. Accordingly, the peak values of the voltages V(n024), V(n017) and V(n012) shown in the respective illustration a) are essentially identical.

As is evident from the respective illustration d), however, the additional setpoint value element provided by the operational amplifier IC1-A, as can be seen from the profile of the voltage V(n009), is all the greater the smaller the peak values of the input voltage $V_e$. In principle, V(n020) shows the sum of the two setpoint value elements. However, it should be considered that in the phases in which the rectified input voltage V(n003) is below an amplitude of 90 V (the forward voltage of the first cascade of LEDs has been assumed to be 90 V in this case, by way of example), the transistor Q011 is turned on by virtue of appropriate dimensioning, as evident from the corresponding profile of the current $I_e$(Q011). As a result, in said phases of the voltage V(n003), the voltage V(n020) is shorted to the voltage of the emitter/base junction of the transistor Q011, this being reflected in a corresponding profile for the voltage V(n016) provided at the output of the operational amplifier IC1-B.

The peak value of the voltage V(n016) is essentially identical in the different illustrations of FIGS. 2 to 4.

While the disclosure has been particularly shown and described with reference to specific embodiments, it should be understood by those skilled in the art that various changes in form and detail may be made therein without departing from the spirit and scope of the disclosure as defined by the appended claims. The scope of the disclosure is thus indicated by the appended claims and all changes which come within the meaning and range of equivalency of the claims are therefore intended to be embraced.

The invention claimed is:

1. An electronic ballast for operating at least one first cascade of LEDs, comprising:

an input having a first and a second input connection for coupling to an AC supply voltage;

a rectifier that is coupled to the first and the second input connection, wherein the rectifier has an output having a first and a second output connection;

a first unit that comprises the first cascade of LEDs, wherein the first unit is coupled to the first output connection of the rectifier;

a series circuit comprising an inphase regulator and a shunt resistor, wherein this series circuit is coupled in series between the first unit and the second output connection of the rectifier;

a setpoint value prescribing apparatus for the inphase regulator having an output that is coupled to the inphase regulator, wherein the setpoint value prescribing apparatus is designed to provide a first setpoint value element at its output, said first setpoint value element being correlated to the voltage between the output connections of the rectifier;

wherein the setpoint value prescribing apparatus is also designed to provide a second setpoint value element for the inphase regulator, wherein the second setpoint value element is inversely correlated to the peak value of the current through the inphase regulator, wherein the setpoint value prescribing apparatus comprises a first voltage divider having a first and a second nonreactive resistor that is coupled between the first and the second output connection of the rectifier, wherein the first setpoint value element is correlated to the voltage drop across the second resistor owing to the current through the first resistor, wherein the setpoint value prescribing apparatus comprises an apparatus element for providing the second setpoint value element, wherein the apparatus element has its input coupled to the shunt resistor and its output coupled to the tap of the first voltage divider, wherein the apparatus element is designed to impress a current that is inversely correlated to the peak value of the current through the inphase regulator into the second nonreactive resistor of the first voltage divider.

2. The electronic ballast as claimed in claim 1, wherein the second nonreactive resistor of the first voltage divider, which is coupled between the tap of the first voltage divider and the second output connection of the rectifier, has a capacitor connected in parallel with it.

3. The electronic ballast as claimed in claim 1, wherein the setpoint value prescribing apparatus comprises a first operational amplifier, the negative input of which is coupled to the shunt resistor, and the positive input of which is coupled to the tap of the first voltage divider.

4. The electronic ballast as claimed in claim 3, wherein the first operational amplifier is connected up such that it acts as a P controller, as a PI controller or as an I controller.

5. The electronic ballast as claimed in claim 1, wherein the apparatus element comprises a second operational amplifier, the positive input of which is coupled to the tap of a second voltage divider coupled to a DC supply voltage, the negative input of which is coupled to the shunt resistor and the output of which is coupled to the tap of the first voltage divider.

6. The electronic ballast as claimed in claim 5, wherein the apparatus element further comprises a diode and a capacitor, wherein the diode is coupled in series between the shunt resistor and the negative input of the second operational amplifier and wherein the capacitor is coupled between the negative input of the second operational amplifier and a reference-ground potential.

7. The electronic ballast as claimed in claim 6, wherein the diode is in the form of a double diode, wherein the node between the two diodes is coupled to a DC supply voltage.

8. The electronic ballast as claimed in claim 6, wherein the capacitor has a third nonreactive resistor connected in parallel with it.

9. The electronic ballast as claimed in claim 6, wherein the second operational amplifier is connected up such that it acts as an I controller.

10. The electronic ballast as claimed in claim 5, wherein the second voltage divider comprises a first and a second nonreactive resistor, wherein the second nonreactive resistor, which is arranged between the tap of the second voltage divider and a reference-ground potential, has a capacitor connected in parallel with it.

11. The electronic ballast as claimed in claim 1, wherein the second nonreactive resistor of the first voltage divider has an auxiliary apparatus coupled to it that is designed to adjust the edge gradient and/or the instant of the onset of the voltage drop across the second nonreactive resistor.

12. The electronic ballast as claimed in claim 11, wherein the auxiliary apparatus comprises an electronic switch having a control electrode, an operating electrode and a reference electrode, wherein the control electrode is coupled to the tap of a third voltage divider having a first and a second nonreactive resistor that is connected in parallel with the first voltage divider.

13. The electronic ballast as claimed in claim 12, wherein the second nonreactive resistor of the third voltage divider, which is coupled between the tap of the third voltage divider and a reference-ground potential, has a zener diode and/or a capacitor connected in parallel with it.

14. The electronic ballast as claimed in claim 13, wherein the first and/or the third voltage divider is coupled to the coupling point between the first unit and the second unit, on the one hand, and the second output connection of the rectifier, on the other hand.

15. The electronic ballast as claimed in claim 1, wherein the electronic ballast further comprises at least one second unit, having a second cascade of LEDs that is coupled between the first unit and the series circuit comprising inphase regulator and shunt resistor, wherein the respective second cascade of LEDs has an electronic switch connected in parallel with it, the first cascade of LEDs particularly also having an electronic switch connected in parallel with it.

16. The electronic ballast as claimed in claim 1, wherein the respective cascade of LEDs has a buffer capacitor connected in parallel with it.

17. The electronic ballast as claimed in claim 16, wherein at least one unit comprises a diode that is coupled in series with the parallel circuit comprising respective LED cascade and respective buffer capacitor.

* * * * *

UNITED STATES PATENT AND TRADEMARK OFFICE

CERTIFICATE OF CORRECTION

PATENT NO. : 9,326,334 B2
APPLICATION NO. : 14/450301
DATED : April 26, 2016
INVENTOR(S) : Klaus Fischer et al.

It is certified that error appears in the above-identified patent and that said Letters Patent is hereby corrected as shown below:

IN THE SPECIFICATION

Column 7, line 37: Please delete "V," between the words "voltage" and "subsequently", and write "$V_e$" in place thereof.

Signed and Sealed this
Twenty-eighth Day of June, 2016

Michelle K. Lee

Michelle K. Lee
*Director of the United States Patent and Trademark Office*